US009496079B2

(12) United States Patent
Khayzikov et al.

(10) Patent No.: US 9,496,079 B2
(45) Date of Patent: Nov. 15, 2016

(54) ELECTRONICALLY-CONTROLLED SOLENOID

(75) Inventors: Yuriy Khayzikov, Granada Hills, CA (US); Ashot Avertisyan, Glendale, CA (US); Sarkis Isayan, Glendale, CA (US); Olavo Jordao, Jr., Valencia, CA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/485,262

(22) Filed: May 31, 2012

(65) Prior Publication Data

US 2013/0321971 A1 Dec. 5, 2013

(51) Int. Cl.

| | |
|---|---|
| ***H01F 7/18*** | (2006.01) |
| ***H01F 7/16*** | (2006.01) |
| ***F02N 11/08*** | (2006.01) |

(52) U.S. Cl.

CPC ..... *H01F 7/1805* (2013.01); *F02N 11/087* (2013.01); *H01F 7/1607* (2013.01)

(58) Field of Classification Search

CPC ..... H01F 7/1816; H01F 7/1805; H01F 7/1607; H01H 47/325; F02D 41/20; F02N 11/087

USPC ..... 361/194, 139

See application file for complete search history.

(56) References Cited

U.S. PATENT DOCUMENTS

| | | | | |
|---|---|---|---|---|
| 3,755,766 | A * | 8/1973 | Read, Jr. | 335/229 |
| 3,761,730 | A * | 9/1973 | Wright | 307/10.1 |
| 4,191,061 | A * | 3/1980 | Miller et al. | 74/108 |
| 4,211,496 | A * | 7/1980 | Naylor | B41J 2/285 101/93.05 |
| 4,251,051 | A * | 2/1981 | Quenneville et al. | 251/129.14 |
| 4,516,185 | A * | 5/1985 | Culligan et al. | 361/154 |
| 4,878,147 | A * | 10/1989 | Oyama et al. | 361/154 |
| 5,141,111 | A * | 8/1992 | Licht | 209/558 |
| 5,422,780 | A * | 6/1995 | Lignar | 361/154 |

(Continued)

FOREIGN PATENT DOCUMENTS

EP 1 594 227 A2 11/2005

OTHER PUBLICATIONS

LM2574 0.5A Step-Down Voltage Regulator, Jun. 1999, Texasd Instrument Inc. pp. 1-26.*

(Continued)

*Primary Examiner* — Zeev V Kitov

(74) *Attorney, Agent, or Firm* — Merchant & Gould P.C.

(57) ABSTRACT

A solenoid assembly includes a switching regulator and a solenoid electrically connected to an output signal connection of the switching regulator, the solenoid electrically actuable between an extended position and a pull-in position. The assembly includes an output level switch electrically connected to an input switching connection and the output signal connection of the switching regulator, and a timer connected to an output of the switching regulator and an input of the output level switch. The timer generates a signal at the output of the output level switch, thereby causing the output level switch to generate a hold signal at the input switching connection of the switching regulator after sensing a signal at the output signal connection. Upon receiving the hold signal at the input switching connection, the switching regulator causes an output signal on the output voltage connection to switch from a switching level to a hold level.

13 Claims, 5 Drawing Sheets

(56) References Cited

U.S. PATENT DOCUMENTS

| | | | | |
|---|---|---|---|---|
| 5,503,805 | A * | 4/1996 | Sugarman et al. | 422/131 |
| 5,574,617 | A | 11/1996 | Shimanuki et al. | |
| 6,671,158 | B1 | 12/2003 | Underwood | |

OTHER PUBLICATIONS

International Search Report and Written Opinion for PCT/US2013/043636 mailed Oct. 9, 2013.

* cited by examiner

ELECTRONICALLY-CONTROLLED SOLENOID

TECHNICAL FIELD

The present application relates generally to a solenoid design; in particular, the present application relates to an electronically-controlled solenoid.

BACKGROUND

Solenoids are commonly-used, electrically actuated transducer devices used to convert electrical energy into linear motion. For example, solenoids can be used as part of a starter in a vehicle, or as part of control systems for other electromechanical devices in which a generally short motion is required. Generally, solenoids include a movable component (such as a plunger) movable between two positions, and biased into one of the two positions (e.g., by a spring). Movement of the plunger to the second position is actuated by current passing through a coil, which induces a magnetic field causing a force to counteract the spring force.

In some applications, solenoids are required that have relatively high pull-in forces and/or long strokes. For example, solenoids used in aviation-type applications, typically are required to have a very strong hold force and are required to have a long actuation stroke. One example of such a high-force, long stroke solenoid is illustrated in FIG. 1. In that arrangement, a solenoid 10 has a solenoid body 12. A plunger 14 is retained partially within the body 12, and movable between extended and pull-in positions. The plunger 14 is biased into the extended position by a spring 16 positioned within the body 12. A coil 18 is also positioned within the body and configured to engage the plunger 14 when it receives a signal (e.g., a current through the coil) of a sufficient magnitude to generate a magnetic signal to counteract the force of the spring 16, thereby moving the plunger 14 to the pull-in position. The solenoid 10 can have a separate interface, shown as the connector 20, by which wires can be connected to the coil 18 for control of the solenoid 10.

These types of solenoids typically have a pull-in force of over 14 lbs. (e.g., 15 lbs.) and strokes (i.e., distance between actuated and non-actuated positions) of over about ¼ inches require special design considerations. The high forces and long strokes drives coil design to a high number of turns, which increases the solenoid weigh, volume, and power dissipation. For example, typically such solenoids require in excess of 2,000 turns in the coil, and may require a hold force of up to 100 lbs.

However, these high forces require high currents to generate a magnetic field of sufficient magnitude; at the same time, a low operating current is required to minimize coil heath, and decrease the electrical power demanded from the system powering the solenoid. In some cases, this demand can be about 45 watts to actuate the solenoid from its extended position to a pull-in position, and 14 watts (continuously) to hold the solenoid in the pull-in, actuated position.

In order to mitigate the high power demands of such specialized solenoids, current is reduced across the coil during a hold period, because the hold force required for a solenoid is generally lower than an actuation force. An example of such a circuit is illustrated in FIG. 2. In this arrangement, the solenoid 10 includes a solenoid coil 18 having a resistance 18*a*, and which is connected in parallel with a diode 22. A voltage can be applied across the solenoid

10 and diode 22, from a voltage connection to a ground (powered) connection. An additional resistor 24 is selectively connectible in series with the combined solenoid 10 and diode 22, to a second ground (hold) connection. To actuate the solenoid, a high current is distributed across the voltage and ground (powered) connection, thereby maximizing the current across the solenoid coil, and actuating the solenoid. Once the solenoid 10 is actuated, an external controller can switch the circuit used such that the same voltage is applied across the voltage and ground (hold) connection, thereby introducing resistor 24 into the circuit and lowering the overall current through the coil 18.

However, even these existing solenoid designs have various disadvantages, because in these circumstances the solenoid still is required to have a very large number of turns and requires a high hold force, thereby dictating that the solenoid is bulky and energy-inefficient.

For these and other reasons, improvements are desirable.

SUMMARY

In accordance with the following disclosure, the above and other issues are addressed by the following:

In a first aspect, a solenoid assembly includes a switching regulator having an input power connection, an input switching connection, and an output signal connection. The solenoid assembly also includes a solenoid electrically connected to the output signal connection of the switching regulator, electrically actuable between an extended position and a pull-in position. The solenoid assembly further includes an output level switch electrically connected to the input switching connection and the output signal connection of the switching regulator. The solenoid assembly includes a timer electrically connected to an output of the switching regulator and an input of the output level switch. The timer is configured to, a predetermined time after sensing a signal on the output of the switching regulator, generate a signal at the output of the output level switch, thereby causing the output level switch to generate a hold signal at the input switching connection of the switching regulator. Upon receiving the hold signal at the input switching connection, the switching regulator causes an output signal on the output voltage connection to switch from a switching level to a hold level.

In a second aspect, an electronically-controlled solenoid includes a solenoid and an electrical circuit. The solenoid includes a plunger electrically actuable between an extended position and a pull-in position, a coil encircling at least a portion of the plunger, and a spring biasing the plunger toward the extended position. The electrical circuit is connected to the coil and configured to generate an actuation signal on the coil, thereby moving the plunger from an extended position to the pull-in position, and, after a predetermined period of time, generate a hold signal on the coil, the hold signal having a lower magnitude than is required to actuate the solenoid from the extended position to the pull-in position.

In a third aspect, a method of operation of a solenoid is disclosed. The method includes receiving a signal at a switching regulator having a current level greater than an actuation threshold, providing a solenoid-actuating signal from the switching regulator to a solenoid, thereby causing a plunger of the solenoid to actuate from an extended position to a pull-in position, and, a predetermined time after transmitting the solenoid-actuating signal, triggering an output level switch to send a signal to the switching regulator, thereby causing the switching regulator to provide a hold signal to the solenoid, the hold signal having a lower magnitude than is required to actuate the solenoid from the extended position to the pull-in position.

DETAILED DESCRIPTION

Figure 1:
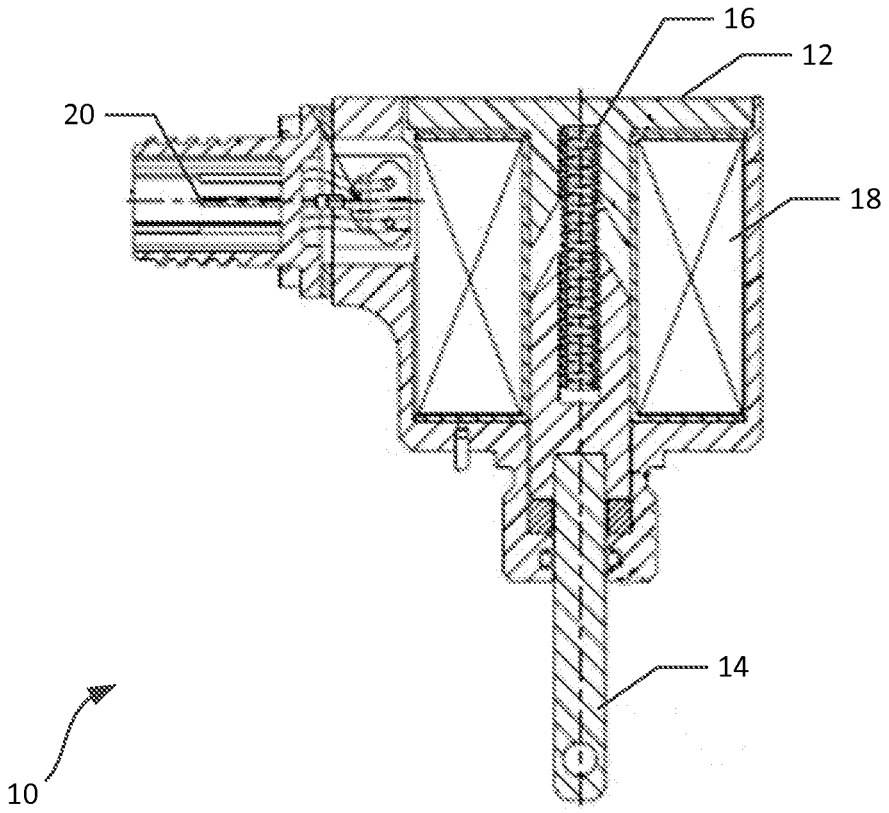
FIGURE 1 (Prior Art)
FIG. 1 is a side cross-sectional view of a prior art solenoid.
Figure 2:
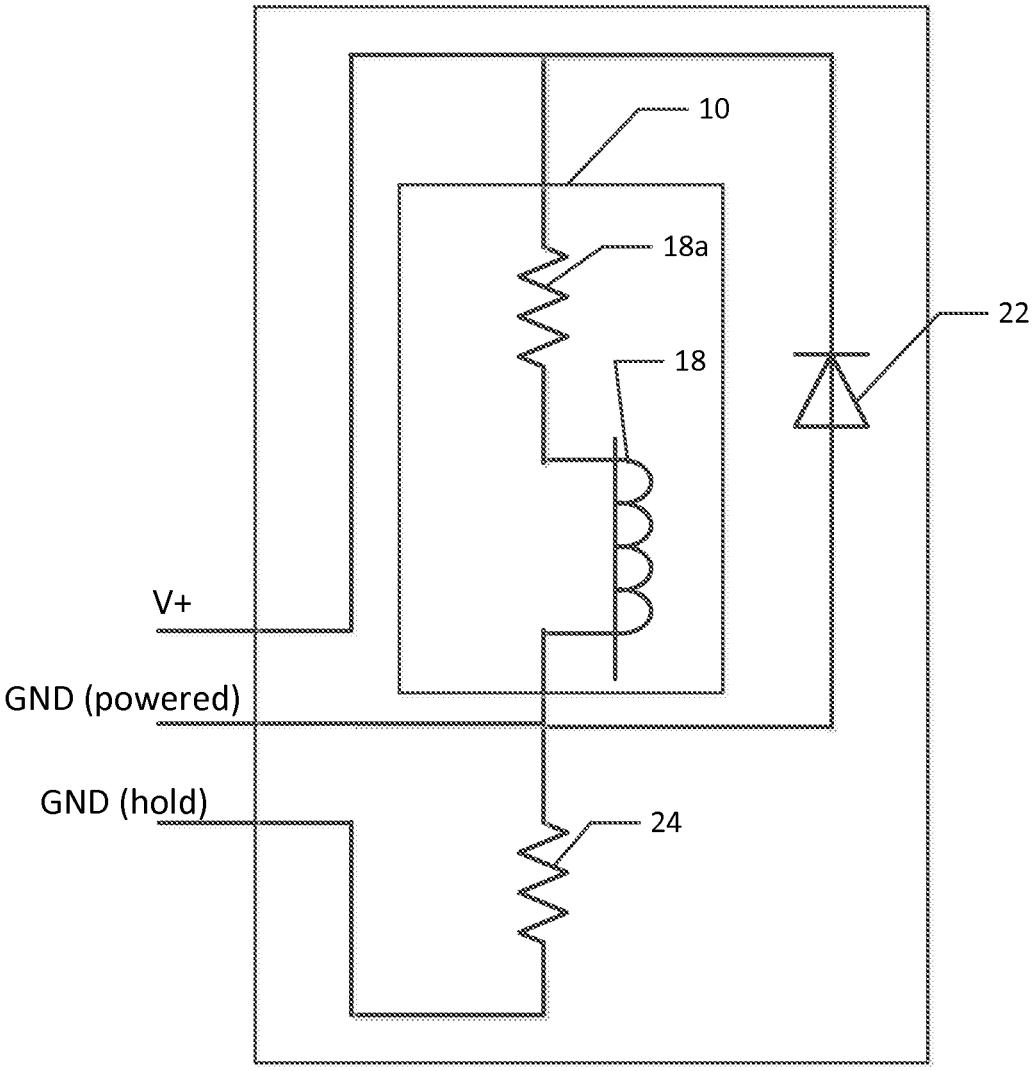
FIGURE 2 (Prior Art)
FIG. 2 is a schematic diagram of a prior art solenoid control circuit.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

The logical operations of the various embodiments of the disclosure described herein are implemented as: (1) a sequence of computer implemented steps, operations, or procedures running on a programmable circuit within a computer, and/or (2) a sequence of computer implemented steps, operations, or procedures running on a programmable circuit within a directory system, database, or compiler.

In general the present disclosure relates to an electronically-controlled solenoid, solenoid assembly, and its method of operation. In accordance with the principles disclosed herein the solenoid arrangements use electronics integrated with the solenoid to maximize a pull-in force, while maintaining a steady-state power consumption and maintaining a high hold force.

Figure 3:
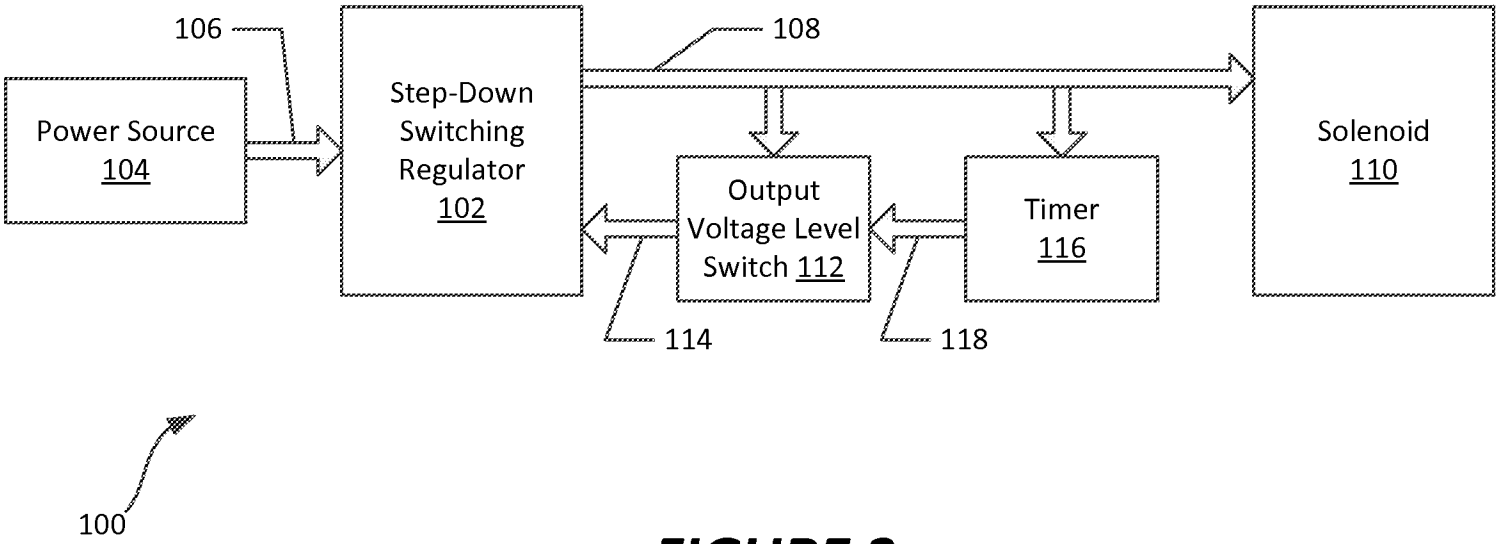
FIG. 3 is a schematic block diagram of a solenoid assembly including an electronically-controlled solenoid, according to an example embodiment.

Referring now to FIG. 3, a schematic block diagram of a solenoid assembly 100 is shown, according to an example embodiment of the present disclosure. In the embodiment shown, the solenoid assembly 100 includes a switching regulator 102 electrically connected to a power source 104. The switching regulator 102 has a plurality of connections, including an input power connection 106 connectable to the power source 104 and an output signal connection 108 communicatively connected to a solenoid 110. In the embodiment shown, the solenoid 110 is electrically connected to the output signal connection 108, such that an output signal of the switching regulator 102 is applied to a coil of the solenoid, as further discussed below in connection with FIG. 4. In general and as discussed in further detail below, the solenoid 110 is electrically-actuable between an extended position (i.e., when inactive) and a pull-in position (when activated). As further discussed below, the solenoid is constructed such that a short-duration, high-current signal level can actuate the solenoid, while a relatively low-current hold signal level can be used to maintain the solenoid in the pull-in position. For example, in some cases, an actuation signal level can provide an approximately 18 volt, 5 amp signal to the solenoid, while a hold signal level can provide an approximately 3 volt, 0.5-1.0 amp signal. Accordingly, although an actuation signal may require about 45 watts, a hold signal may, in the embodiment shown, only require a 5 watt continuous power draw. Other signal levels are possible as well, according to other alternative embodiments.

The power source 104 can be any of a variety of types of power sources; generally, the power source 104 provides a high-current signal to the solenoid assembly 100. In various embodiments, the power source 104 can provide in the range of 18-32 volts or more, while delivering up to or exceeding about 5 amps of current to the solenoid 110 via the switching regulator 102; the specific current provided to the solenoid 110 will vary based on the particular output level (voltage) of the switching regulator 102. In example embodiments, the power source 104 can be provided as a remote connection to a separate control system or power source (e.g., a battery) configured to actuate the solenoid assembly 100.

An output level switch 112 is electrically connected to the output signal connection 108 of the switching regulator 102, and an output of the switch is connected to an input switching connection 114 of the switching regulator. Based on a state of a signal at the input switching connection 114, the switching regulator 102 can selectively emit one of two or more levels of signals at the output signal connection 108; an actuation signal level which is sufficient to actuate the solenoid 110, or a hold level signal, lower than the actuation signal level, sufficient to maintain actuation of the solenoid 110 once actuated.

A timer 116 is also electrically connected to the output signal connection 108 of the switching regulator 102, and has a timer output 118 connected to the output level switch 112. The timer 116 is configured to, upon sensing a signal at the output signal connection 108, wait a predetermined time, and then trigger a signal at the timer output 118 to be communicated to the output level switch 112. In some embodiments, the timer 116 begins counting upon sensing a particular signal level on the output signal connection 108, such as a voltage above a predetermined threshold, thereby allowing the timer to distinguish between an actuation signal level and a hold signal level on the output signal connection 108. Furthermore, in various embodiments, the timer 116 can wait different or adjustable amounts of time after the signal is detected at the output signal connection 108. The amount of time defined by the timer 116 can vary in differing embodiments; in some embodiments, the timer triggers a signal approximately 75 milliseconds after detecting a signal, but in other embodiments could be a longer amount of time. In one example embodiment useable in an aircraft door securing application, the timer triggers a signal on the timer output 118 approximately 200 milliseconds after detecting a signal.

In operation, the power source 104 will transmit a high-voltage signal to the switching regulator 102, at the input power connection 106. The switching regulator 102 will pass the power signal onto the output signal connection 108, which then transmits that signal to the solenoid 110, as well as the output level switch 112 and timer 116. The solenoid 110, now receiving a full-voltage signal from the switching regulator 102 capable of actuating the solenoid (i.e., typically at or exceeding about 18 volts, and thereby resulting in approximately 5 amps), will actuate, and the timer 116 will be activated. After a predetermined amount of time, the timer 116 will generate a signal on the timer output 118 to be transmitted to the output level switch 112, which in turn transmits a hold signal to the switching regulator 102 on the input switching connection 114. Upon sensing the hold signal, the switching regulator 102 will adjust the signal on the output signal connection 108 to reduce the current through the solenoid 110; for example, the switching regulator can cause a hold signal to be transmitted at the output signal connection 108, at a level of approximately 3 volts, resulting in an approximately 0.5 to 1.0 amp current through the solenoid, depending upon the particular electrical characteristics of the solenoid employed in the assembly 100. Once the signal from the power source 104 is deactivated, the solenoid can return to its extended position, since the hold signal level at the output signal connection 108 is interrupted.

It is noted that using the switching regulator 102 and associated output level switch 112 and timer 116 of the present disclosure, it is possible to use a solenoid capable of receiving a high current, without worrying about attendant overheating or shortened life span, or other issues that may otherwise arise in a solenoid having a relatively large number of turns in the coil. Additionally, because the high-current portion of the signal is only required during actuation of the solenoid 110, fast discharge of a battery or other energy source representing the power source 104 can be avoided. Accordingly, issues of high persistent current through the coil (thereby causing heat and shortening a solenoid life span) and sufficiently high pull-in force (and long stroke) are effectively decoupled by using an electronic switching arrangement.

Figure 4:
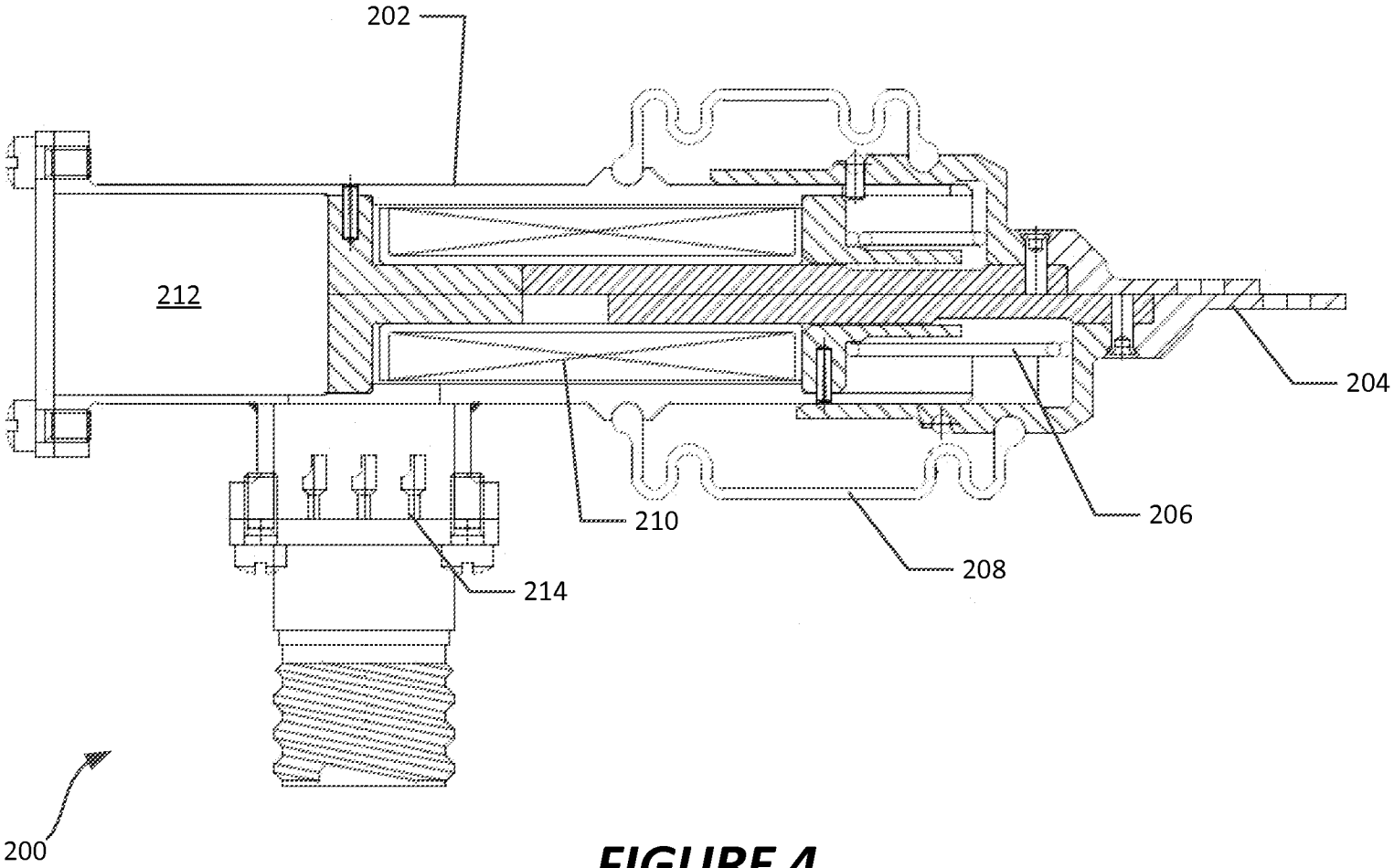
FIG. 4 is a side cross-sectional view of an electronically-controlled solenoid, according to an example embodiment.

Referring to FIG. 4, an example side cross-sectional view of an electronically-controlled solenoid 200 is illustrated, according to an example embodiment. The electronically-controlled solenoid 200 can be used, for example, in the solenoid assembly 100 of FIG. 3.

In the embodiment shown, the electronically-controlled solenoid 200 includes a solenoid housing 202, defining an exterior of the solenoid. A plunger 204 at least partially protrudes from the housing 202, and is movable between extended and pull-in positions. The plunger 204 is biased toward the extended position by a spring 206, which is positioned within the housing 202 and at least partially encircles the plunger 204.

In various embodiments, the housing 202 can take a variety of forms; in the embodiment shown, the housing 202 includes an environmental boot 208 surrounding a portion of the housing and the plunger 204. The plunger 208 is physically connected to the housing and the plunger 204, and is flexible to accommodate movement of the plunger between the extended (non-actuated) and pull-in (actuated) positions. In an example embodiment, the distance between an extended position and a pull-in position is relatively long, and can be, for example, approximately ¼ inches. Other pull in stroke distances are possible as well.

The housing 202 also contains a coil 210 positioned around at least a portion of the plunger 204, and which is electrically connected to electronics 212 within the housing 202. The coil 210 can, when current is applied, generate a magnetic field capable of overcoming a biasing force of the spring 206, and thereby move the plunger 204 from the extended position to the pull-in position. The coil 210, in various embodiments, can include a plurality of turns, of a number generally lower than in other solenoid devices having high force and/or long strokes. In the example embodiment shown, the coil has fewer than about 500 turns, and in a particular embodiment includes about 450 turns. When an actuation signal is applied to the coil 210, it has, in the various embodiments discussed herein, a pull-in force in excess of about 15 pounds, and can in some embodiments approach or even exceed 100 pounds.

The electronics 212 can include a variety of elements capable of actuating the coil 210; in example embodiments, the electronics can include the switching regulator 102, output level switch 112, and timer 116 discussed above in connection with FIG. 3.

Optionally, in the embodiment shown, the housing 202 includes an electronics interface 214, which includes one or more electrical connections capable of electrically connecting to the electronics 212 (and thereby to the coil 210). For example, the electronics interface 214 can lead to a remote power supply or control circuitry for the electronically-controlled solenoid 200.

In addition to the above, it is recognized that in addition to the plunger 204, coil 210, and electronics 212, additional features can be incorporated within the housing 202 of the solenoid 200, depending upon its particular application, or a form factor in which it is designed to reside.

Figure 5:
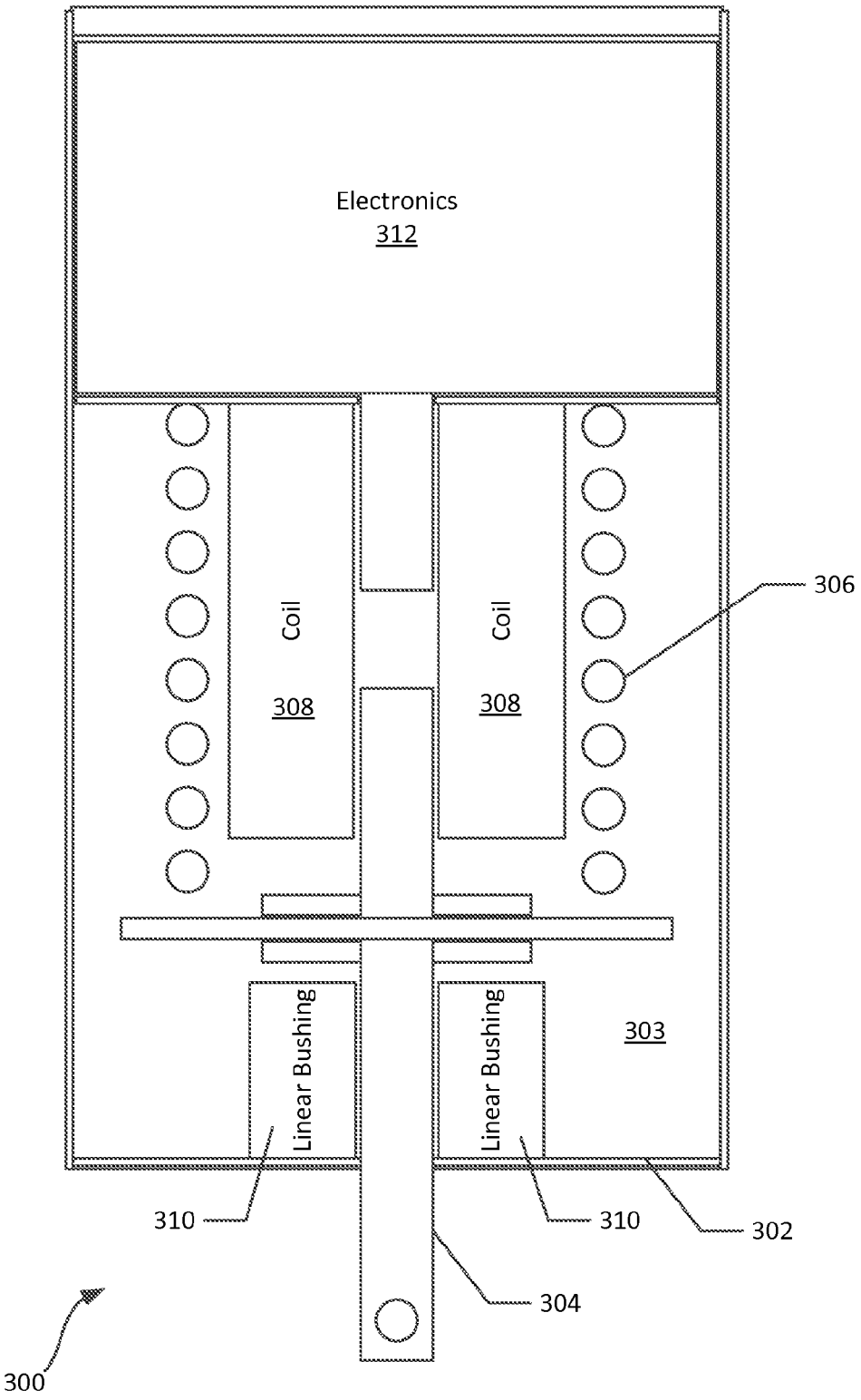
FIG. 5 is a schematic diagram of an assembly including an electronically-controlled solenoid, according to an example embodiment.

Referring now to FIG. 5, a schematic diagram of an assembly 300 including an electronically-controlled solenoid is illustrated. The assembly 300 illustrates in further detail various functional components of an electronically-controlled solenoid, such as that illustrated in FIG. 4, but is generally generic to various types of solenoid designs.

In the embodiment shown, the solenoid assembly 300 includes a solenoid having a housing 302 which at least partially encloses a plunger 304. The plunger 304 is actuable between an extended position and a recoiled, or pull-in, position. A spring 306 is positioned within an interior 303 of the housing 302 and at least partially encircles the plunger 304, while biasing the plunger 304 toward the extended position. A coil 308 also is positioned within the housing 302, and is also at least partially encircled by the spring 306. The coil 308 at least partially encircles the plunger 304 (i.e., is approximately concentric with the spring 306), and is configured to generate a magnetic force capable of overcoming force generated by the spring, thereby moving the plunger to the pull-in position. A linear bushing 310 can also be positioned to surround the plunger 304 at a location where it enters the interior 303 of the housing 302. Current through the coil 308 can be driven by electronics 312, which can, in various embodiments, correspond to electronics 212 of FIG. 4.

Referring to FIGS. 4-5 generally, the solenoid assembly 300 and electronically controlled solenoid 200 can be operated by, among other steps, receiving a signal at a switching regulator having a current level greater than an actuation threshold, and then providing a solenoid-actuating signal from the switching regulator to a solenoid, thereby causing the plunger of that solenoid (e.g., plunger 304, 204) to actuate from an extended position to a pull-in position. After the solenoid is actuated, an output level switch is triggered within the electronics (e.g., electronics 312, 212) to send a signal to a switching regulator, thereby causing the switching regulator to provide a hold signal to the solenoid. The hold signal has a lower magnitude than is required to actuate the solenoid from the extended position to the pull-in position.

Referring to FIGS. 3-5 generally, it is recognized that the solenoid assembly and related electronically-controlled solenoid has a variety of advantages over existing solenoids. For example, the electronically-controlled solenoid designs discussed herein generally require a lower number of turns in the coil, and therefore have a lower weight and lower power dissipation than existing high-amperage, high-force, long pull-in distance solenoid designs. Additionally, the electronically-controlled solenoid designs generally have smaller dimensions, and do not require an external switching device for controlling the solenoid action. Furthermore, the electronically-controlled solenoid designs discussed herein have generally lower power consumption due to improved control of the input signal received from the power source and delivered to the solenoid coil.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A solenoid assembly comprising:

a switching regulator having an input power connection, an input switching connection, and an output signal connection;

a solenoid including a solenoid coil, the solenoid coil including fewer than 500 turns and being electrically connected to the output signal connection of the switching regulator, the solenoid electrically actuable between an extended position and a pull-in position, wherein a distance between the extended position and a pull-in position is at least about ¼ inches and a pull-in force of the solenoid exceeds about 14 pounds;

an output level switch electrically connected to the input switching connection and the output signal connection of the switching regulator;

a timer electrically connected to an output of the switching regulator and an input of the output level switch, the timer configured to, a predetermined time after sensing a signal on the output of the switching regulator, generate a signal at the output of the output level switch, thereby causing the output level switch to generate a hold signal at the input switching connection of the switching regulator;

wherein, upon receiving the hold signal at the input switching connection, the switching regulator causes an output signal on the output signal connection to switch from a switching level to a hold level, wherein the switching level is at a first signal value having a first voltage value of at least 18 volts and a first current value and the hold level is at a second signal value having a second voltage value and a second current value, and wherein the first voltage value is higher than the second voltage value and the first current value is higher than the second current value;

wherein the second signal value has a magnitude sufficient to maintain the solenoid in the pull-in position but lower than is required to actuate the solenoid from the extended position to the pull-in position.

2. The solenoid assembly of claim 1, further comprising a power source electrically connected to the input power connection of the switching regulator.

3. The solenoid assembly of claim 1, wherein the power source has a voltage of at least about 8 volts.

4. The solenoid assembly of claim 1, wherein the switching level exceeds a voltage required to actuate the solenoid from the extended position to the pull-in position.

5. The solenoid assembly of claim 4, wherein the hold level exceeds a current required to maintain the solenoid in the pull-in position and is lower than the current required to actuate the solenoid from the extended position to the pull-in position.

6. The solenoid assembly of claim 1, wherein the predetermined time is greater than or equal to about 75 milliseconds.

7. The solenoid assembly of claim 1, wherein the solenoid includes a plunger movable between the extended position and the pull-in position.

8. An electronically-controlled solenoid comprising:

a solenoid including:

a plunger electrically actuable between an extended position and a pull-in position, wherein a distance between the extended position and a pull-in position is at least about ¼ inches and a pull-in force of the solenoid exceeds about 14 pounds;

a coil encircling at least a portion of the plunger, the coil including fewer than 500 turns;

a spring biasing the plunger toward the extended position;

an electrical circuit connected to the coil, the electrical circuit configured to generate an actuation signal of at least 18 volts on the coil, thereby moving the plunger from an extended position to the pull-in position, and, after a predetermined period of time, generate a hold signal on the coil, the hold signal having a voltage magnitude that is sufficient to maintain the solenoid in the pull-in position but lower than is required to actuate the solenoid from the extended position to the pull-in position.

9. The electronically-controlled solenoid of claim 8, wherein the electrical circuit includes a switching regulator, an output level switch, and a timer.

10. The electronically-controlled solenoid of claim 9, wherein the switching regulator includes an input power connection, an input switching connection, and an output signal connection.

11. The electronically-controlled solenoid of claim 10, wherein the output level switch is electrically connected to the input switching connection and the output signal connection of the switching regulator.

12. The electronically-controlled solenoid of claim 11, wherein the timer is electrically connected to an output of the switching regulator and an input of the output level switch.

13. A method of operation of a solenoid, the method comprising:

receiving a signal at a switching regulator having a current level greater than an actuation threshold;

providing a solenoid-actuating signal of at least 18 volts from the switching regulator to a solenoid coil of solenoid, the solenoid coil including fewer than 500 turns, thereby causing a plunger of the solenoid to actuate from an extended position to a pull-in position, wherein a distance between the extended position and a pull-in position is at least about ¼ inches and a pull-in force of the solenoid exceeds about 14 pounds;

a predetermined time after transmitting the solenoid-actuating signal, triggering an output level switch to send a signal to the switching regulator, thereby causing the switching regulator to provide a hold signal to the solenoid, the hold signal having a lower voltage magnitude than is required to actuate the solenoid from the extended position to the pull-in position.

* * * * *